US009847576B2

(12) United States Patent
Maier et al.

(10) Patent No.: US 9,847,576 B2
(45) Date of Patent: Dec. 19, 2017

(54) UHF-RFID ANTENNA FOR POINT OF SALES APPLICATION

(71) Applicant: NXP B.V., Eindhoven (NL)

(72) Inventors: Stefan Maier, Gratkorn (AT); Benno Flecker, Gratkorn (AT); Dariusz Mastela, Gratkorn (AT); Gerald Wiednig, Stainz (AT)

(73) Assignee: NXP B.V., Eindhoven (NL)

( * ) Notice: Subject to any disclaimer, the term of this patent is extended or adjusted under 35 U.S.C. 154(b) by 209 days.

(21) Appl. No.: 14/077,123

(22) Filed: Nov. 11, 2013

(65) Prior Publication Data

US 2015/0130677 A1 May 14, 2015

(51) Int. Cl.

| | |
|---|---|
| ***H01Q 19/26*** | (2006.01) |
| ***H01Q 7/00*** | (2006.01) |
| ***H01Q 1/22*** | (2006.01) |
| ***H01Q 19/18*** | (2006.01) |
| *H01Q 19/32* | (2006.01) |
| *H01Q 1/24* | (2006.01) |

(52) U.S. Cl.

CPC ..... *H01Q 7/00* (2013.01); *H01Q 1/2216* (2013.01); *H01Q 19/18* (2013.01); *H01Q 1/243* (2013.01); *H01Q 19/26* (2013.01); *H01Q 19/32* (2013.01); *Y10T 29/49016* (2015.01)

(58) Field of Classification Search

CPC ..... H01Q 1/2216; H01Q 19/18; H01Q 7/00; H01Q 5/49; H01Q 5/378; H01Q 5/385; H01Q 5/392; H01Q 19/005; H01Q 19/26; H01Q 19/32; H01Q 1/243; H01Q 5/0065; H01Q 21/061; H01Q 9/16; H01Q 9/18; H01Q 9/20; H01Q 9/27; H01Q 9/285; H01Q 9/265; H01Q 5/48

USPC ..... 343/742, 744, 748, 833, 834, 837, 867, 343/822, 739, 773, 835, 836, 741, 866

See application file for complete search history.

(56) References Cited

U.S. PATENT DOCUMENTS

| | | | | | |
|---|---|---|---|---|---|
| 2,166,750 | A | * | 7/1939 | Carter | H01Q 7/00 343/742 |
| 2,243,523 | A | * | 5/1941 | Davis | G01S 1/02 342/398 |
| 3,611,389 | A | * | 10/1971 | Coors | G01S 1/02 333/238 |
| 3,624,658 | A | * | 11/1971 | Voronoff | H01Q 9/27 343/739 |
| 3,757,341 | A | * | 9/1973 | Gilbo | H01Q 3/242 342/371 |
| 4,115,780 | A | * | 9/1978 | Goodman | H01Q 21/20 343/739 |

(Continued)

FOREIGN PATENT DOCUMENTS

JP 2004297499 A 10/2004

OTHER PUBLICATIONS

Extended European Search Report, Application No. 14188698, dated Mar. 10, 2015.

(Continued)

*Primary Examiner* — Hoang Nguyen
*Assistant Examiner* — Awat Salih

(57) ABSTRACT

A UHF-RFID antenna having a central segmented loop surrounded by passive dipole structures provides shaping of the electric and magnetic fields to reduce the number of false positive reads by a UHF-RFID reader at a point of sale.

16 Claims, 20 Drawing Sheets

(56) References Cited

U.S. PATENT DOCUMENTS 5,528,252 A * 6/1996 Skahill ..... H01Q 9/16 343/820
6,008,773 A * 12/1999 Matsuoka ..... H01Q 19/108 343/700 MS
6,697,028 B1 * 2/2004 Gothard ..... H01Q 19/191 343/781 CA
6,839,038 B2 * 1/2005 Weinstein ..... H01Q 1/38 343/792.5
7,486,250 B2 * 2/2009 Vetrovec ..... G01N 21/3581 343/795
8,537,063 B2 * 9/2013 Lindenmeier ..... H01Q 7/00 343/728
8,599,083 B2 * 12/2013 Lindenmeier ..... H01Q 7/00 343/741
8,723,748 B2 * 5/2014 Svensson ..... H01Q 9/16 343/700 MS
8,982,008 B2 * 3/2015 Parsche ..... H01Q 1/243 235/385
9,270,010 B2 2/2016 Blumberg, Jr.
9,391,362 B1 * 7/2016 Kim ..... H01Q 1/36
2004/0201479 A1 10/2004 Garber et al.
2005/0088342 A1 * 4/2005 Parsche ..... H01Q 1/38 343/700 MS
2007/0109210 A1 * 5/2007 Bacquet ..... H01Q 7/00 343/742
2008/0048867 A1 * 2/2008 Oliver ..... H01Q 1/22 340/572.7
2008/0204326 A1 * 8/2008 Zeinolabedin Rafi ..... H01Q 9/0414 343/700 MS
2009/0009414 A1 * 1/2009 Reykowski ..... G01R 33/3415 343/742
2009/0146902 A1 * 6/2009 Li ..... H01Q 21/061 343/867
2009/0178930 A1 7/2009 Lochtman et al.
2009/0284431 A1 * 11/2009 Meharry ..... H01Q 9/065 343/816
2009/0295659 A1 12/2009 Blumberg, Jr.
2010/0277386 A1 * 11/2010 Iliev ..... G06K 19/07749 343/788
2011/0210824 A1 9/2011 Stewart
2013/0328740 A1 * 12/2013 Blumberg, Jr. ..... A47J 31/40 343/822
2016/0013554 A1 * 1/2016 Yamaguchi ..... H01Q 7/00 343/867

OTHER PUBLICATIONS

Dobkin, D. M. et al. "Segmented Magnetic Antennas for Near-Field UHF RFID", Microwave Journal, 5 pgs, (Jun. 14, 2007).

* cited by examiner

UHF-RFID ANTENNA FOR POINT OF SALES APPLICATION

BACKGROUND

Current RFID (Radio Frequency Identification) systems are able to replace barcode systems in many applications. RFID tagging of clothes and other items such as groceries is seeing increased interest in the respective industries. RFID tagging of goods allows the goods to be tracked throughout the supply chain. At the end of the supply chain is the point of sales (POS) application. Typically, a barcode based product scanner is used at the POS to identify the sold products. Based on the information from the POS terminal, all data throughout the supply chain is updated (e.g. inventory) as well as the generation of a customer's bill and deactivation of any security system after customer payment is received.

Barcode POS systems typically have a very low detection range which means that a barcode tag is only readable when positioned such that the barcode tag faces the light beam of the scanner. This typically requires the tagged object to be repositioned until the proper alignment is achieved with the scanner or the scanner needs to be repositioned with respect to the barcode (e.g. handheld scanner) until the proper alignment is achieved as shown in FIGS. 1*a-c*. FIGS. 1*a-b* show product 115 with barcode 120 in orientations which do not permit scanner 110 to scan barcode 120. FIG. 1*c* shows product 115 with barcode 120 oriented such that scanner 110 can scan barcode 120.

Using an RFID system for tagging enables a more efficient way to scan products passing a POS because an RFID tag attached to a product need not be aligned with the antenna. FIGS. 2*a-c* show some of the alignments permissible in an RFID system with product 215, RFID reader antenna 210 and RFID tag 220. RFID tag 220 may be read using randomly chosen alignments between reader antenna 210 and product 215. Typically RFID systems provide a detection range which results in a larger volume than a barcode system.

Prior art UHF-RFID systems typically have a problem with false positive reads, such as shown in FIG. 3. The electromagnetic radiation pattern of RFID antenna 310 of the reader (not shown) leads to the detection of products 315 with RFID tags 320, 321, 322 and 323 arranged near RFID antenna 310 at POS 300 when only RFID tag 320 on RFID antenna 310 is to be detected. Hence, products 315 from different customers at POS 300 could be read at the same time.

SUMMARY

In accordance with the invention, a UHF-RFID reader antenna is disclosed with a defined radiation pattern that provides a controlled read range to suppress false positive readings of RFID tags. Special passive antenna dipole structures are used to control the RF propagation area resulting in a defined read zone with a reduction of false positive reads.

DETAILED DESCRIPTION

Figure 4A:
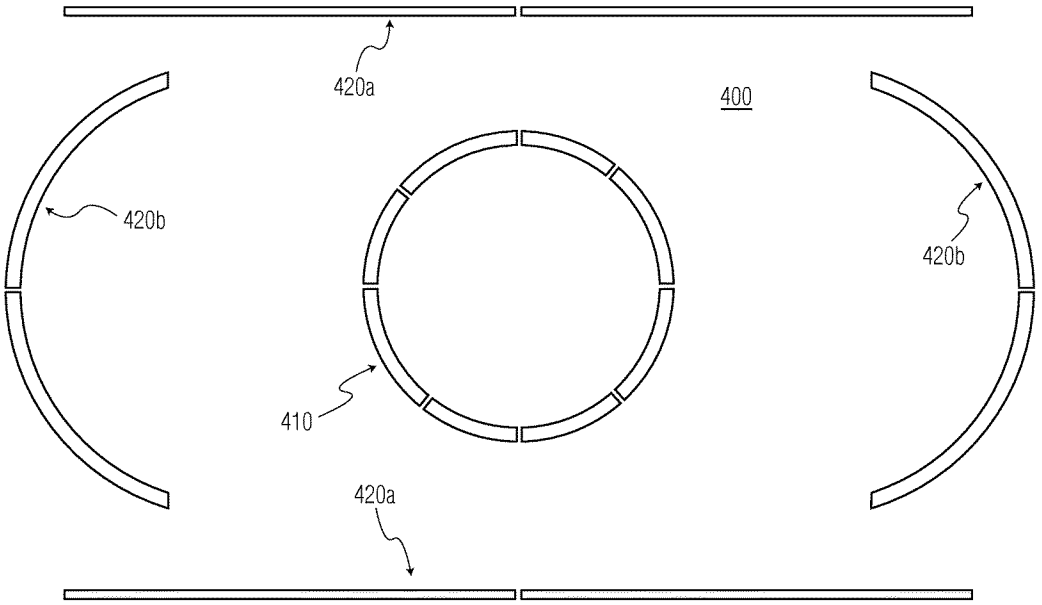
FIG. 4*a* shows an embodiment in accordance with the invention.

FIG. 4*a* shows RFID antenna 400 in an embodiment in accordance with the invention. Segmented loop 410 is surrounded by passive dipole structures 420*a* and 420*b* which confine the RF field emitted by segmented loop 410. Loop segmentation allows an electrically large antenna to behave like an electrically small antenna. The segmented sections provide for very small phase delays between adjacent sections and the currents along segments 515 (see FIG. 5) remain constant in magnitude which results in a strong and uniform magnetic field. Selecting a segment length to be on the order of ⅛ wavelength allows for a compromise between structure complexity and current uniformity in the loop segments.

Figure 4B:
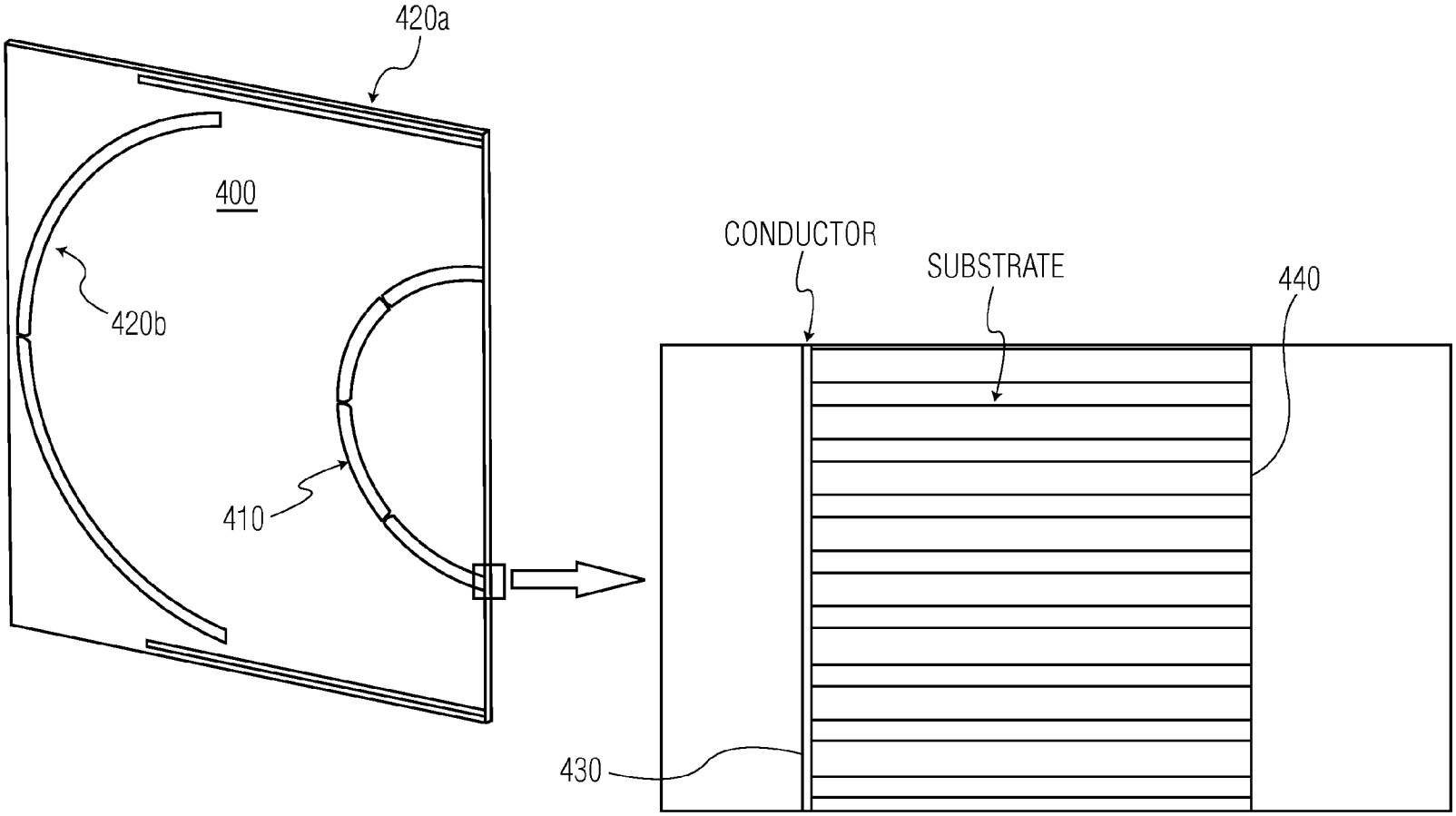
FIG. 4*b* shows an embodiment in accordance with the invention.

RFID antenna 400 can be made in accordance with the invention by placing conductive material 430 (e.g. copper) on dielectric substrate 440 as shown in FIG. 4*b*. The thickness of conductive material 430 typically needs to be selected to fit the application. Typically 1.5 mm thickness FR4 material (fiberglass reinforced epoxy laminate) is selected for dielectric substrate 440 and is typically paired with 0.035 mm thickness copper for conductive material 430. Suitable FR4 material typically has a dielectric constant $\in_r$ of approximately 4.3. Dielectric substrate 440 influences the resonance length of RFID antenna 400. The physical size of an antenna placed on dielectric substrate 440 is scaled down by a scaling factor for the same resonance frequency compared to an antenna having the same resonance frequency surrounded by air as long as dielectric substrate 440 has a higher dielectric constant than air. The scaling factor is proportional to $1/\sqrt{\in_r}$.

RFID antenna 400 comprises conductor traces, lumped elements (resistors, capacitors, connector(s), balun(s)) and dielectric substrate 440. RFID antenna 400 has a structure similar to the structure of one layer PCB boards and this typically allows for easy production.

Figure 5:
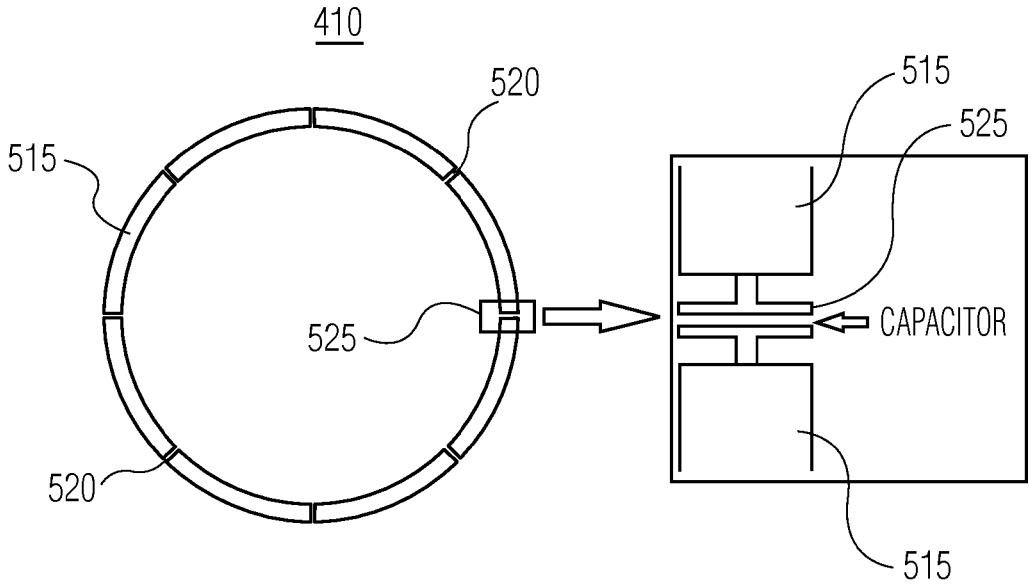
FIG. 5 shows an embodiment in accordance with the invention.

RFID antenna 400 can be viewed as comprising two main parts. Segmented loop 410 which operates as the radiating antenna and passive dipole structures 420*a* and 420*b* which shape the radiated field by reflecting and absorbing the radiated energy outside the defined read zone. FIG. 5 shows segmented loop 410 where segments 515 of segmented loop 410 are separated from each other by gaps 520 and coupled to each other using capacitors 525. Segmented loop 410 is designed such that the diameter and resonance frequency is appropriate for the desired application.

Segmented loop 410 can be scaled arbitrarily where the diameter of segmented loop 410 and the values of capacitors 525 affect the resonance frequency of segmented loop 410. Segments 515 of segmented loop 410 are typically on the order of one-eighth of the resonant wavelength in length as noted above. If the circumference of segmented loop 410 would require longer segments 515, additional segmentation is typically introduced to keep segment length constant.

Figure 6A:
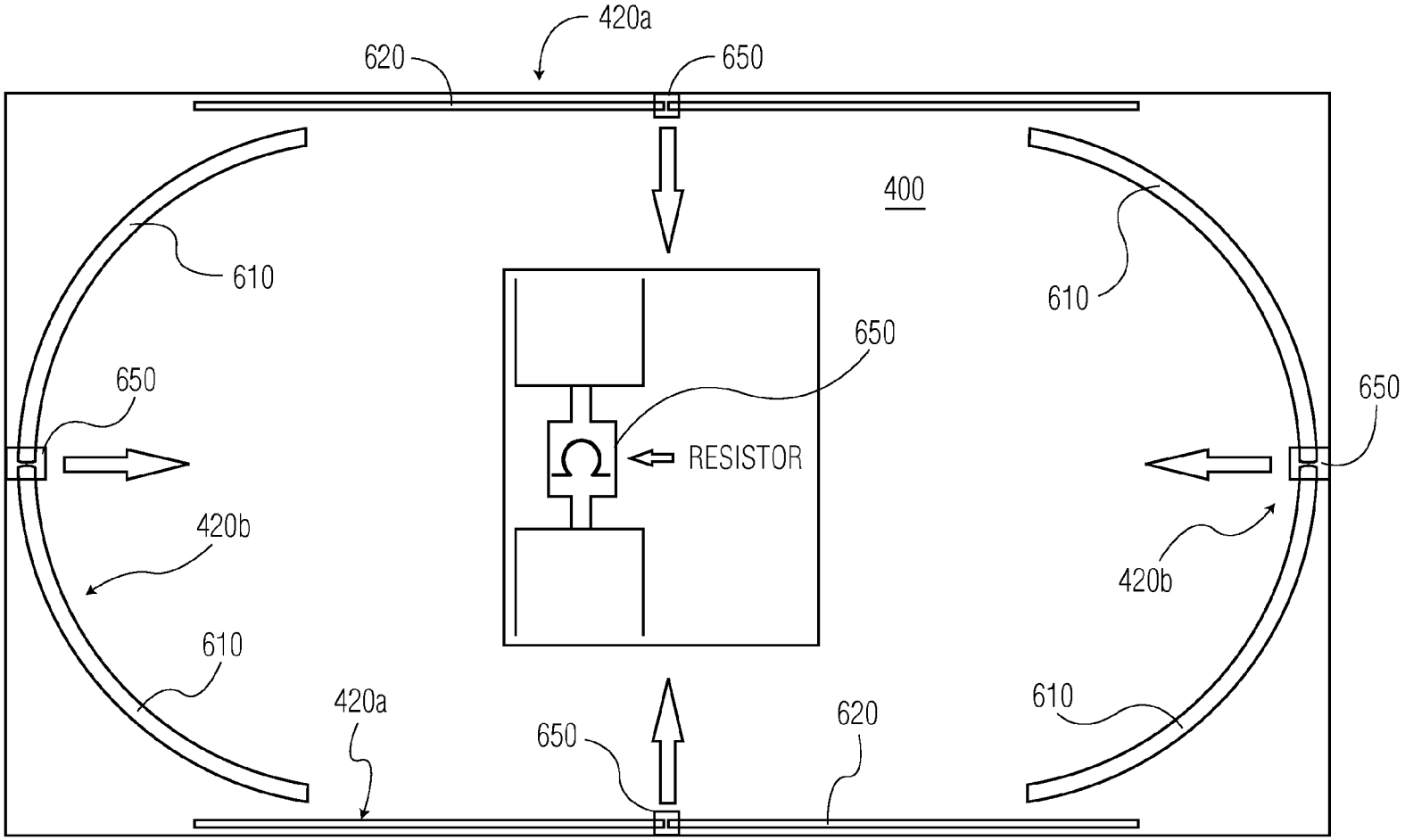
FIG. 6*a* shows an embodiment in accordance with the invention.

FIG. 6*a* shows passive dipole structures 420*a* and 420*b* in an embodiment in accordance with the invention which suppresses the electromagnetic field outside of the desired read zone. The desired read zone is defined mainly by the radiated power of segmented loop 410 (see FIG. 5) and the performance of the passive RFID tag (not shown) which is scanned using antenna 400. Typically, the read zone is defined for a particular application and then with a knowledge of all the components of the RFID system, a reader antenna such as antenna 400 can be designed having the desired read zone.

Passive dipole structures 420*a* and 420*b* are comprised of a total of 4 linear segments 620 and 4 curved segments 610, respectively. Each pair of linear segments 620 and curved segments 610 is coupled to each other using resistors 650 as shown in FIG. 6*a*. The length and width of passive dipole structures 420*a* and 420*b* are selected to match the resonance frequency of segmented loop 410.

Figure 6B:
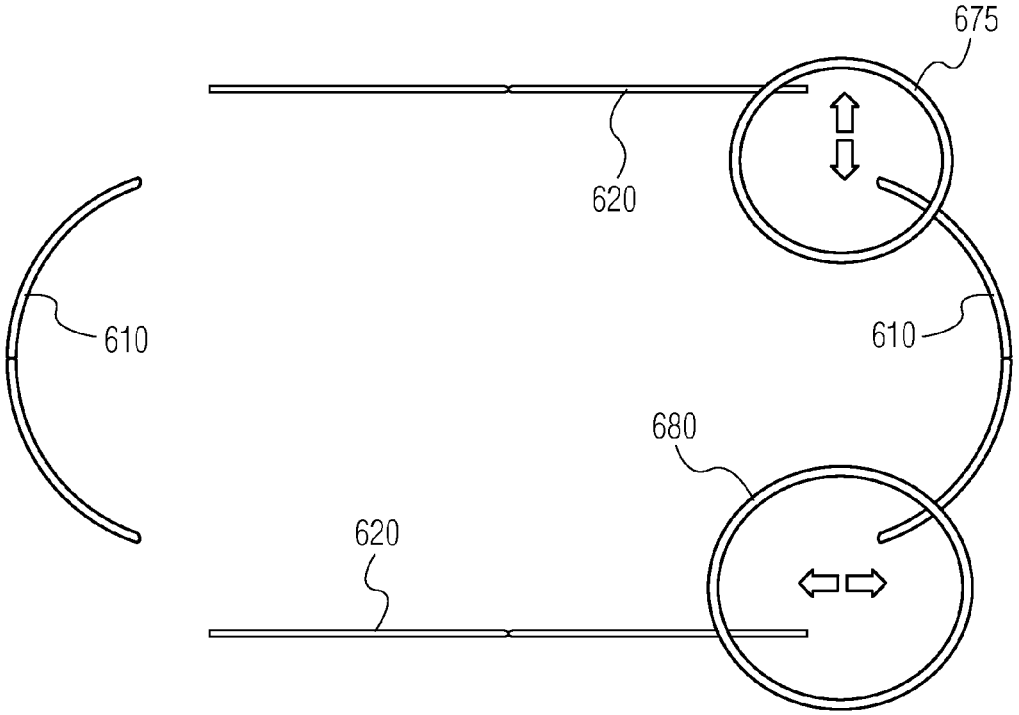
FIG. 6*b* shows an embodiment in accordance with the invention.

Passive dipole structures 420*a* and 420*b* function as reflectors and energy absorbers. The distance from segmented loop 410 to passive dipole structures 420*a* and 420*b* has to be appropriately selected to assure proper performance. FIG. 6*b* shows distances 675 and 680. Distance 680 typically needs to be selected such that the end of curved segment 610 aligns in the y-direction with the end of linear segment 620 or curved segment 610 overlaps with straight segment 620 (e.g., see FIG. 6*a*).

Figure 6C:
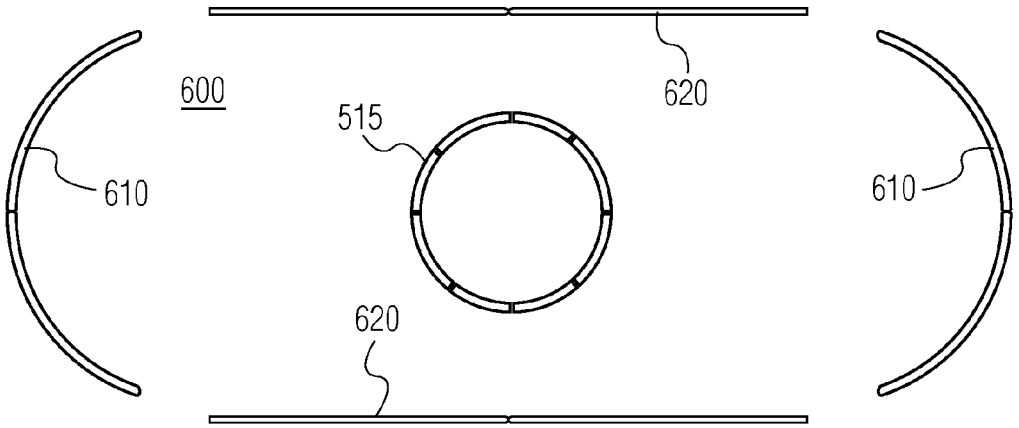
FIG. 6*c* shows an embodiment not in accordance with the invention.
Figure 6D:
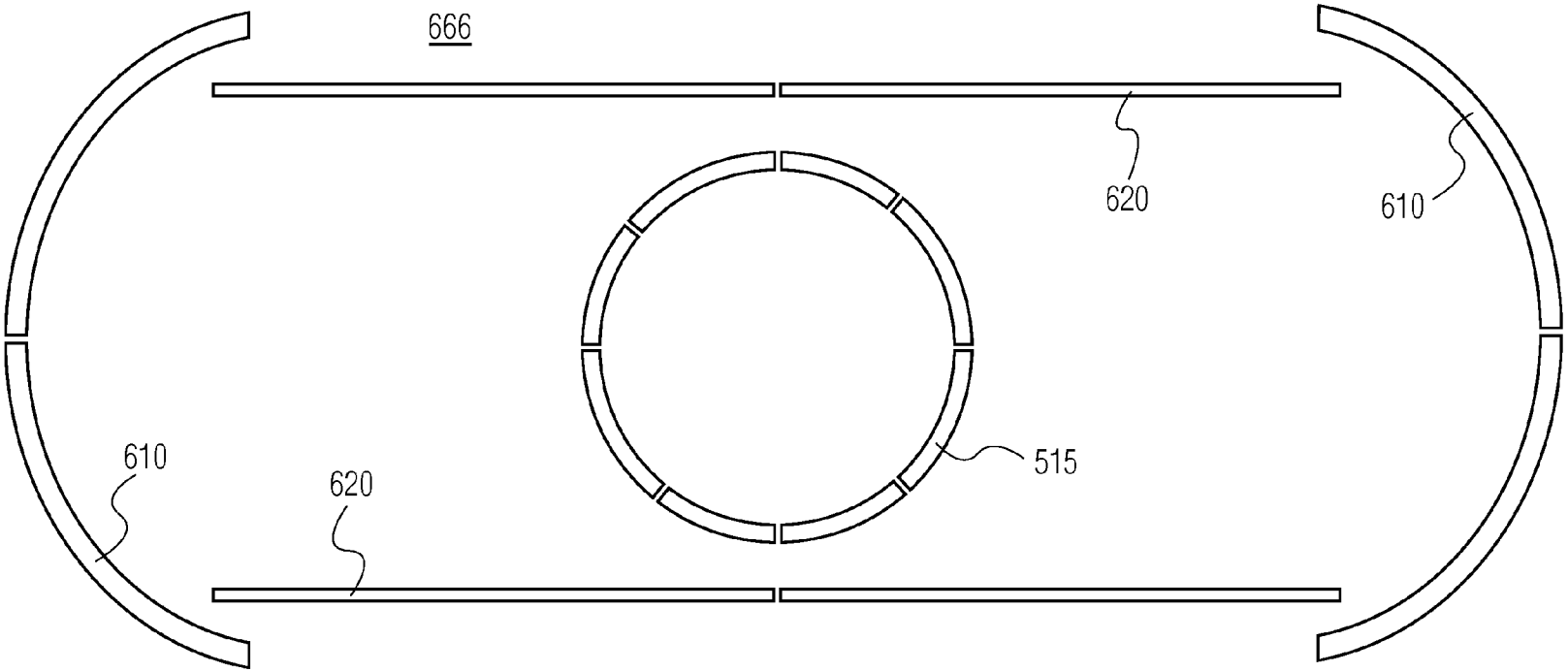
FIG. 6*d* shows an embodiment in accordance with the invention.

Note that in an embodiment in accordance with the invention, curved segment 610 may overlap on the outside of straight segment 620 as shown in FIG. 6*d* for antenna 666.

FIG. 6*c* shows antenna 600 where distance 680 is not properly adjusted resulting in the elimination of the field suppressing effect but all other dimensions are the same as for antenna 400.

Figure 6E:
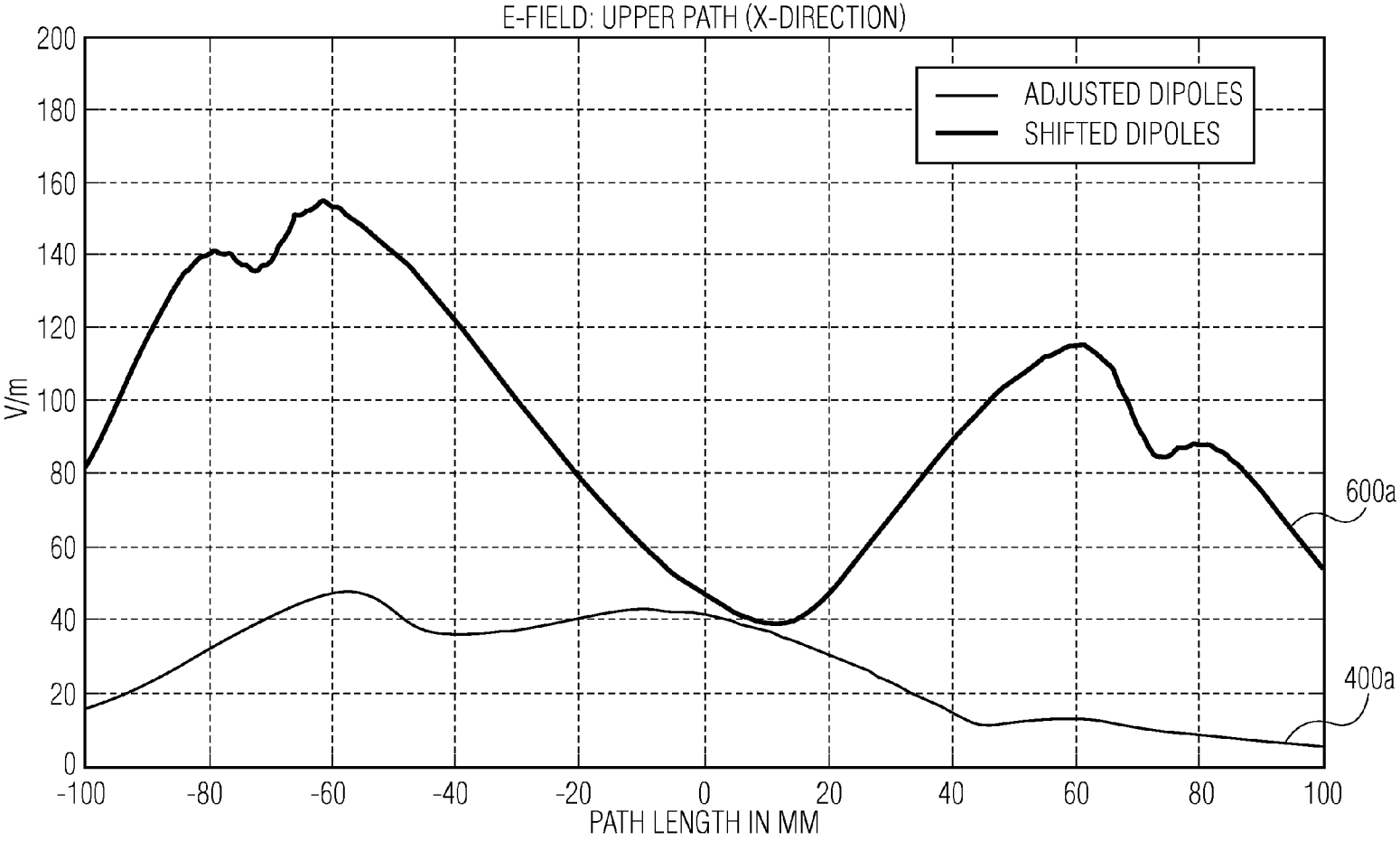
FIG. 6*e* compares the electric field of an embodiment in accordance with the invention with an embodiment not in accordance with the invention.

FIG. 6*e* compares the electric field 400*a* of antenna 400 with the electric field 600*a* of antenna 600 along the direction of respective linear segments 620 showing the elimination of the desired field suppressing effect for antenna 600 in an embodiment in accordance with the invention. Electric field 600*a* is plotted from the point x=−100 mm, y=50 mm, z=10 mm to the point x=100 mm, y=50 mm, z=10 mm where x=0, y=0 and z=0 defines the center of segmented loop 410. Note that if segmented loop 410 is increased in circumference for antenna 400, typically resulting in a larger read zone, passive dipole structures 420*a* and 420*b* are scaled accordingly to preserve the field suppressing effect and lowering the resonance frequency of segmented loop 410 and passive dipole structures 420*a* and 420*b* but typically not to the same degree.

According to the Yagi-Uda configuration, the distance between segmented loop 410 and passive dipole structures 420*a* and 420*b* (see FIG. 4*a*) determines the reflective behavior of passive dipole structures 420*a* and 420*b* (see for example: "Antenna Theory and Design", $2^{nd}$ edition, Stutzman, W. L.; Thiele, G. A.; Wiley 1998 incorporated by reference in its entirety). Note that typical "rules of thumb" for the Yagi-Uda configuration cannot typically be used because there are five coupled antenna structures, four passive dipole structures 420*a* and 420*b* and segmented loop 410 along with dielectric substrate 440 so that numerical simulations are typically needed to find the appropriate geometry. Because the resonance frequency of passive dipole structures 420*a* and 420*b* matches the resonance frequency of segmented loop 410, passive dipole structures 420*a* and 420*b* couple efficiently to segmented loop 410 to reflect and also partially absorb energy from the radiative field emitted by segmented loop 410. To prevent passive dipole structures 420*a* and 420*b* from re-radiating, resistors 650 are placed in the middle of each of the passive dipole structures 420*a* and 420*b* (see FIG. 6*a*). Resistors 650 function to dissipate the energy absorbed by passive dipole structures 420*a* and 420*b*.

Typically, RFID antenna 400 is connected to the RFID reader using a cable having a standard SMA (SubMiniature version A) connector, followed by an unbalanced to balanced converter or balun (not shown) to suppress radiating fields in the cable. The balun used is typically a current balun with very high common mode impedance.

Figure 7:
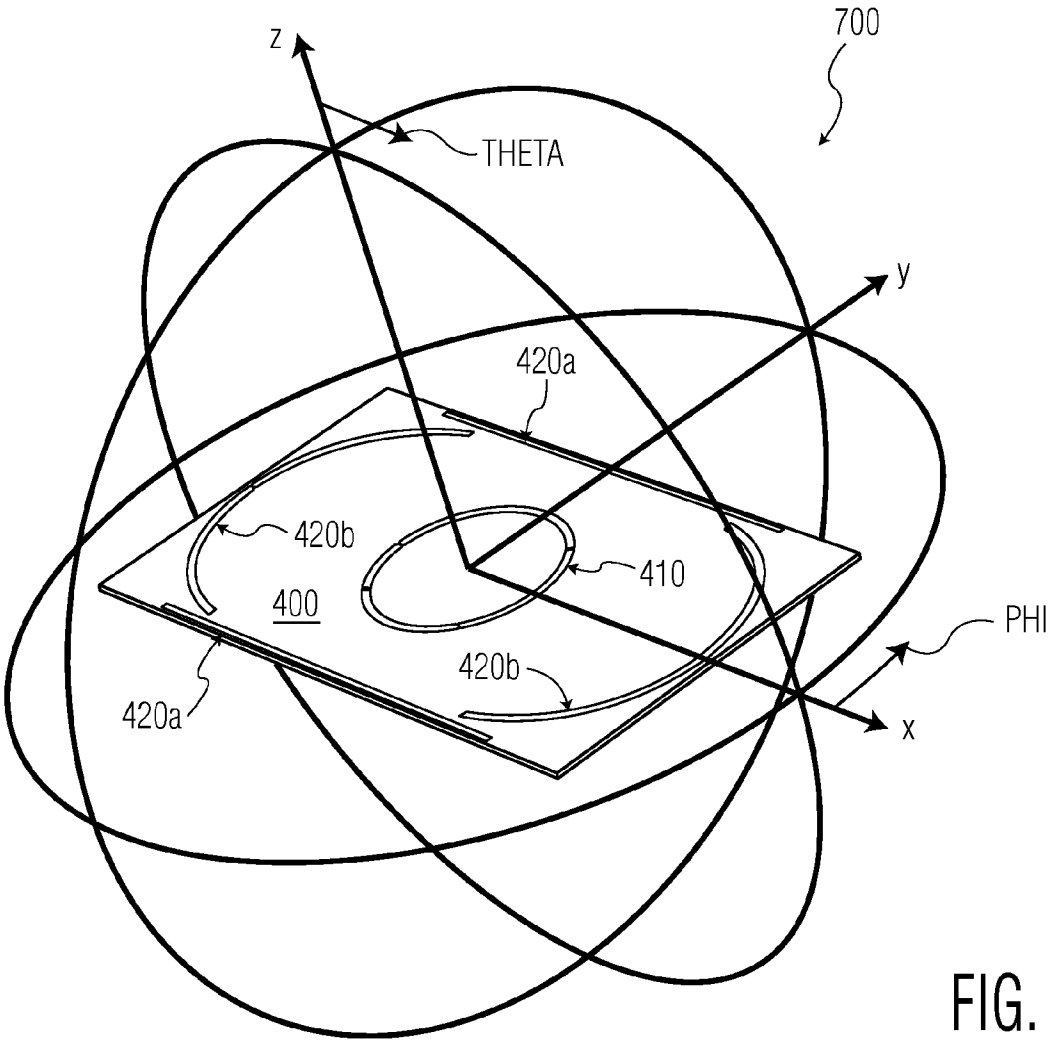
FIG. 7 shows the coordinate system used for FIGS. 8*a-b*.
Figure 8A:
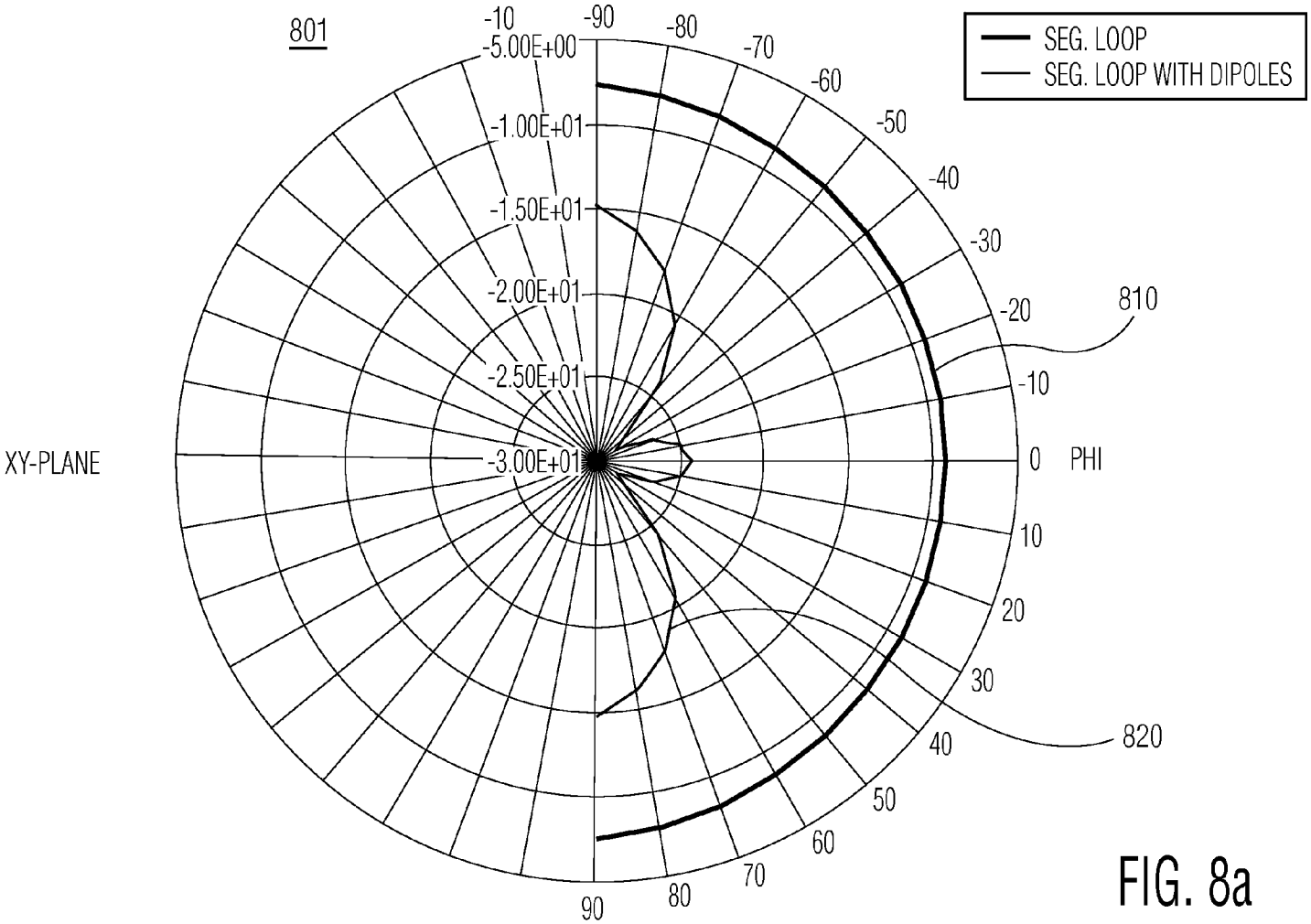
FIG. 8*a* shows the gain as a function of angle in the XY plane for an embodiment in accordance with the invention.
Figure 8B:
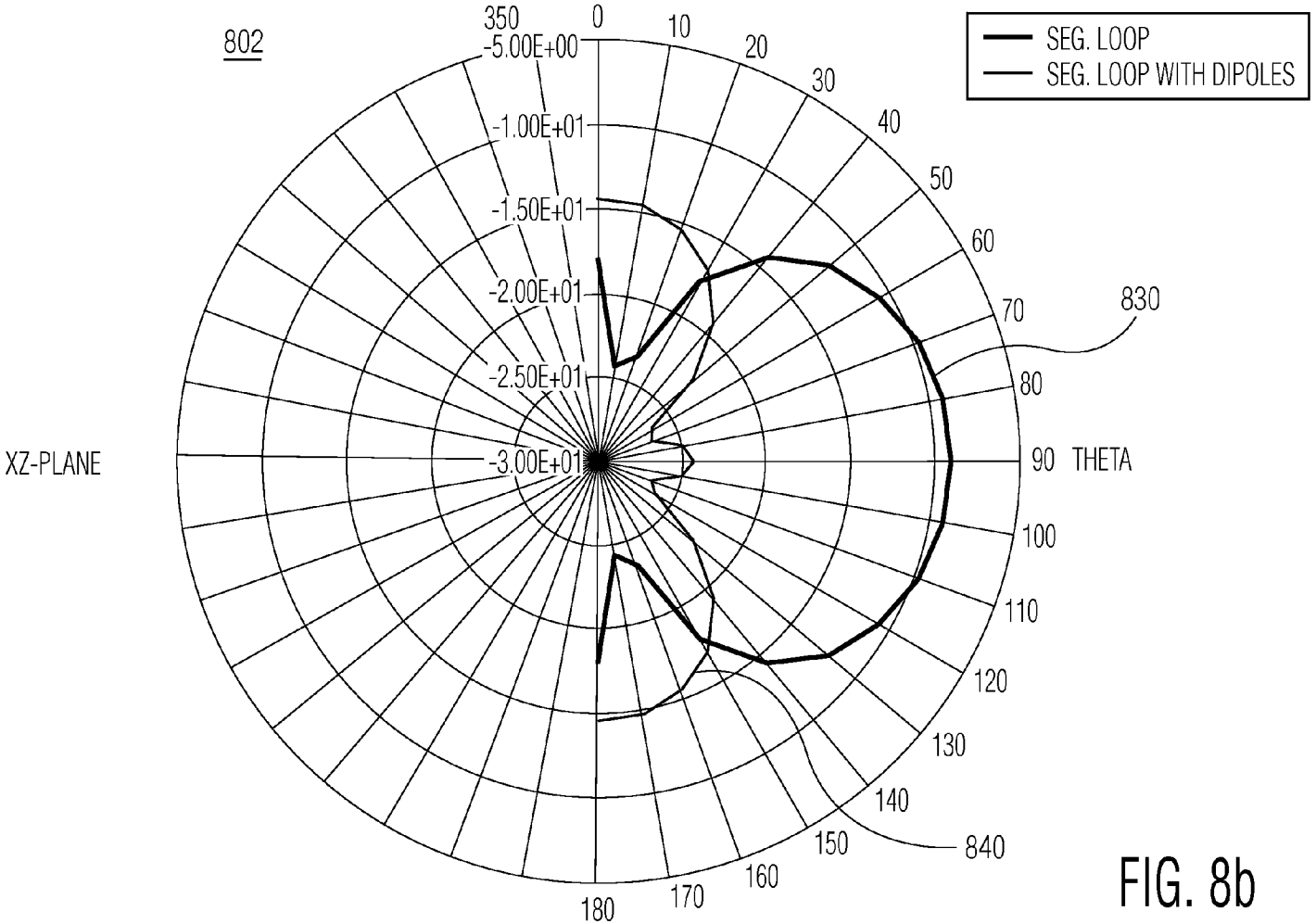
FIG. 8*b* shows the gain as a function of angle in the XZ plane for an embodiment in accordance with the invention.

FIG. 7 shows the coordinate system 700 used for plots 801 and 802 in FIGS. 8*a* and 8*b*, respectively.

Plot 801 in FIG. 8*a* compares gain pattern 810 for segmented loop 410 without passive dipole structures 420*a* and 420*b* with gain pattern 820 for segmented loop 410 with passive dipole structures 420*a* and 420*b* in the XY plane (see FIG. 7). Plot 801 goes from PHI=−90 degrees to PHI=+90 degrees. Plot 802 in FIG. 8*b* compares gain pattern 830 for segmented loop 410 without passive dipole structures 420*a* and 420*b* with gain pattern 840 in the XZ plane (see FIG. 7). Plot 802 goes from THETA=0 degrees to THETA=+180 degrees. Note that matching circuit 931 includes the balun (not shown) and the SMA connector (not shown) at gap 930 which serves as the feed-in point introduces asymmetries which are suppressed to some extent by the balun. However, the effect of the balun and the feed-in point is not modeled in FIGS. 8*a-b*.

Figure 1A:
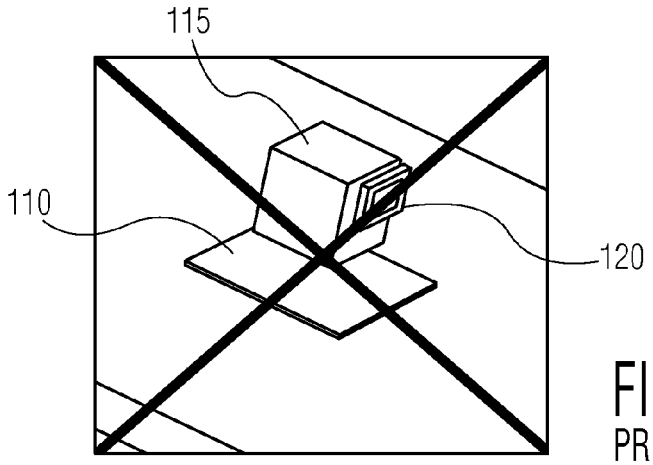
FIG. 1a PRIOR ART
FIGS. 1*a-b* show a product with a barcode in orientations which do not permit the scanner to scan the barcode.
Figure 1B:
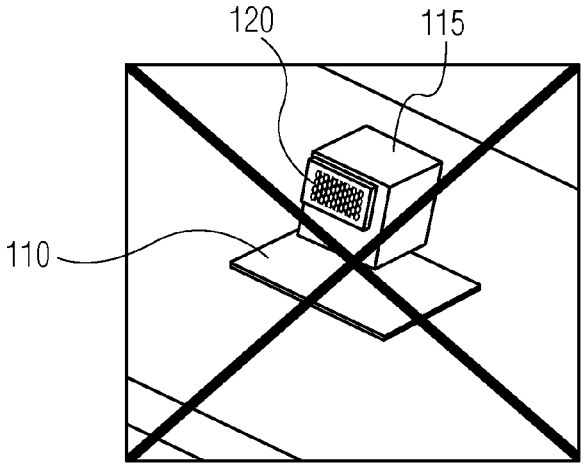
FIG. 1b PRIOR ART
Figure 1C:
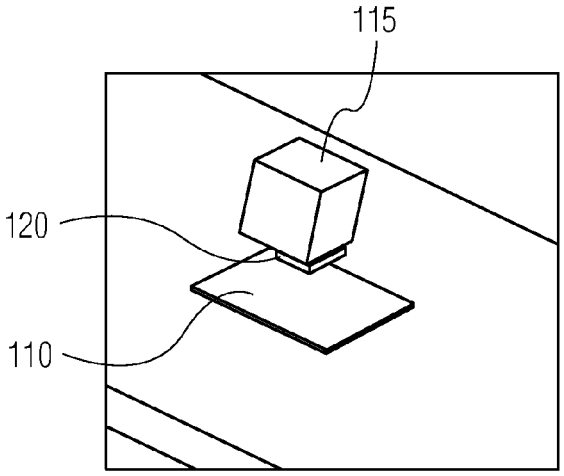
FIG. 1c PRIOR ART
FIG. 1*c* shows product with a barcode in an orientation which permits the scanner to scan the barcode.
Figure 2A:
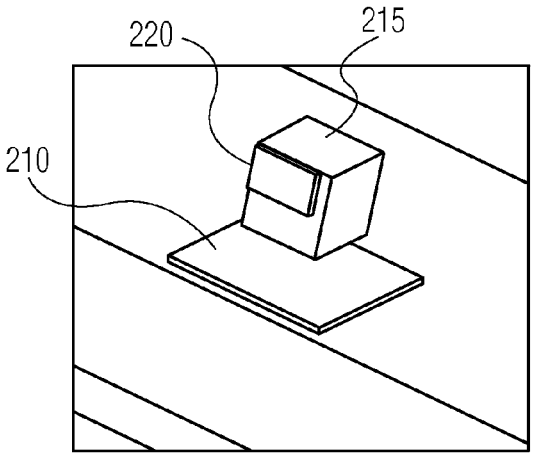
FIG. 2a PRIOR ART
FIGS. 2*a-c* show some of the product orientations permissible in an RFID system.
Figure 2B:
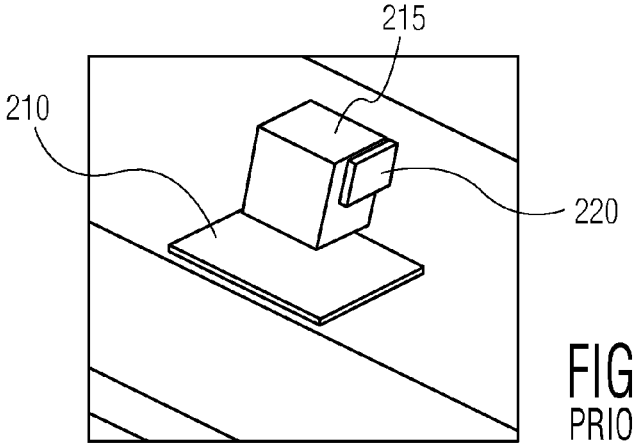
FIG. 2b PRIOR ART
Figure 2C:
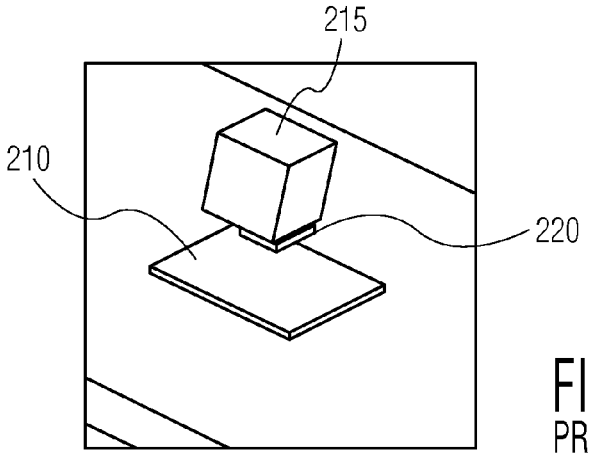
FIG. 2c PRIOR ART
Figure 3:
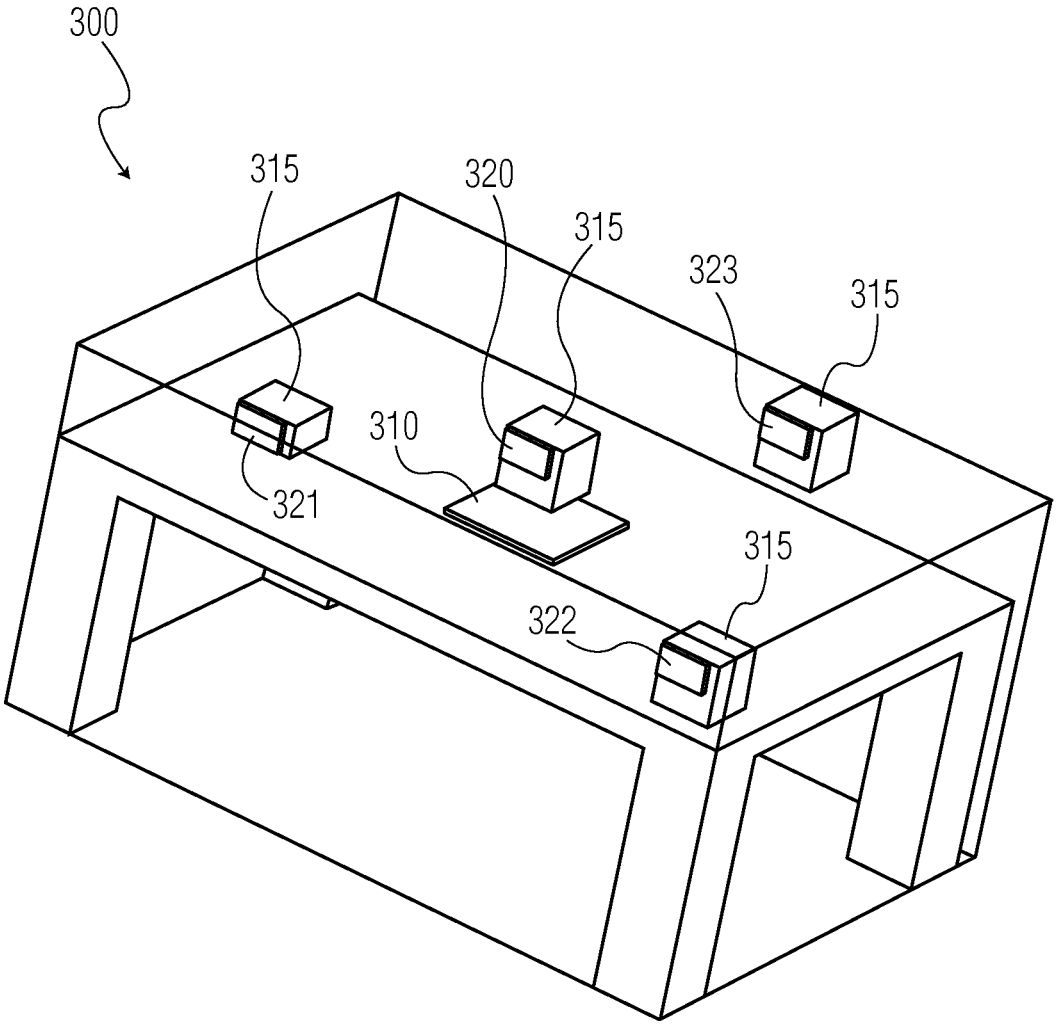
FIG. 3 PRIOR ART
FIG. 3 shows the issue of false positive reads in a UHF-RFID system.

From FIGS. 8*a-b* it is apparent that without passive dipole structures 420*a* and 420*b*, the largest gains are obtained in the x-direction and y-direction which is the plane of RFID antenna 310 in FIG. 3 where reduced sensitivity is desired to reduce false positive reads at POS 300. Passive dipole structures 420*a* and 420*b* reshape gain patterns 810 and 830 into gain patterns 820 and 840, respectively to enhance sensitivity in the z-direction as shown in FIG. 8*b* while reducing sensitivity in the x-direction and the y-direction as seen in FIGS. 8*a-b*. In accordance with the invention, the combination of segmented loop 410 and passive dipole structures 420*a* and 420*b* creates a well-defined read zone for antenna 400 with a higher gain in the z-direction and a suppressed gain in the x-direction and the y-direction.

Figure 9:
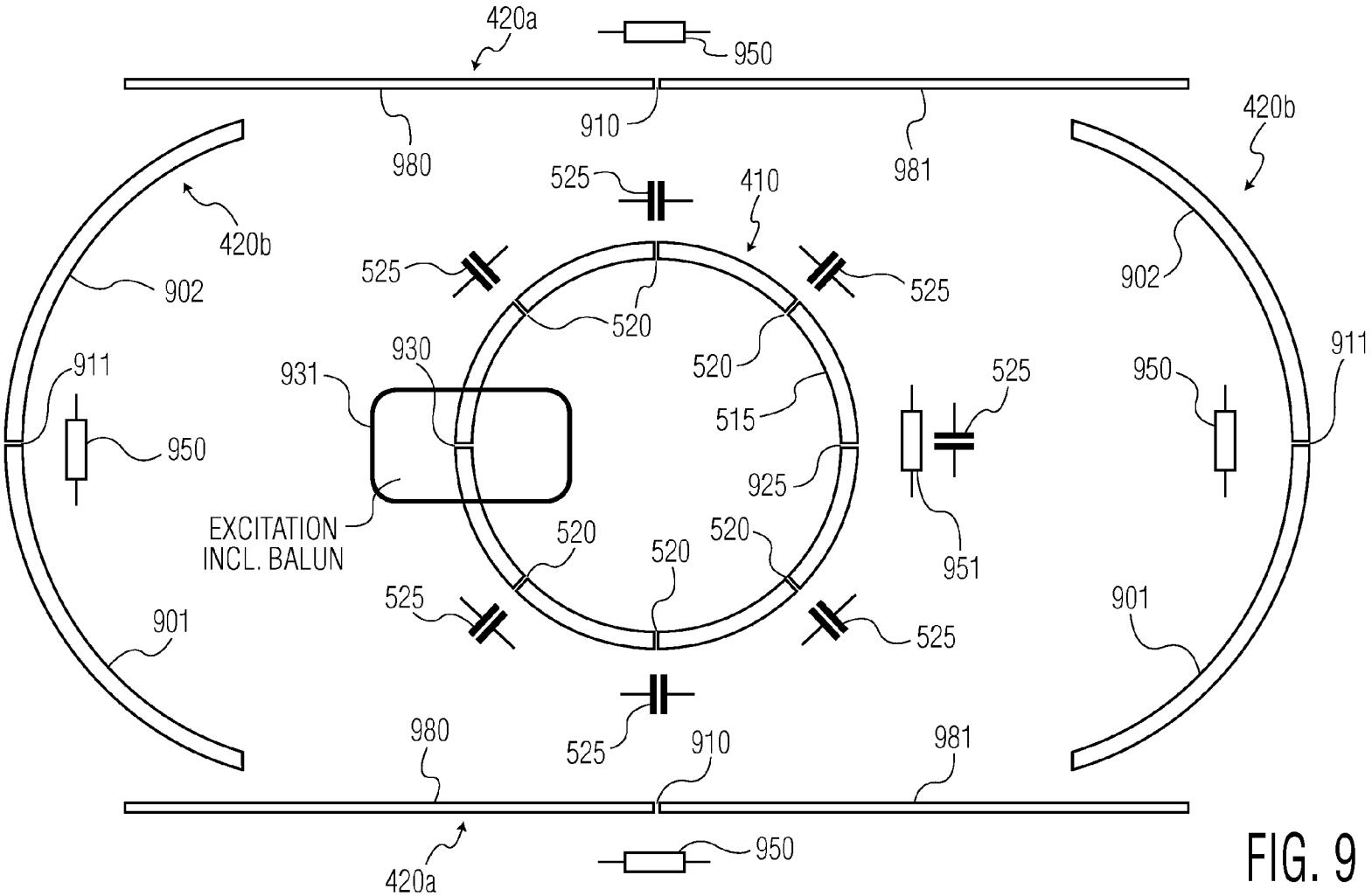
FIG. 9 shows an embodiment in accordance with the invention.

FIG. 9 shows an embodiment in accordance with the invention. Linear segments 980 and 981 of passive dipole structures 420*a* are electrically coupled to each other across gaps 910 by 50Ω resistors 950 which act as terminators. Curved segments 901 and 902 of passive dipole structures 420*b* are electrically coupled to each other across gaps 911 by 50Ω resistors 950 which act as terminators. Gaps 520 separate some of the segments 515 of segmented loop 410 and gaps 520 are bridged by 1.3 pF capacitors 525 which couple the respective segments 515 together to achieve a resonance frequency of about 915 MHz. Note that capacitors 525 resonate out the inductance of segments 515, keeping the impedance of segmented loop 410 manageable. By varying the value of capacitors 525, the resonance frequency can be adjusted to frequency values within the UHF RFID band. Gap 925 is bridged by both 1.3 pF capacitor 525 and 91Ω resistor 951 in parallel to achieve more robust matching between the 50Ω system (not shown) comprising the reader and cable and segmented loop 410. 91Ω resistor 951 functions to sufficiently decrease the Q of segmented loop 410. Gap 930 corresponds to the feed-in slot for excitation of segmented loop 410. Matching circuit 931 includes a balun between the cable from the reader and the feed-in slot (gap 930).

Figure 10:
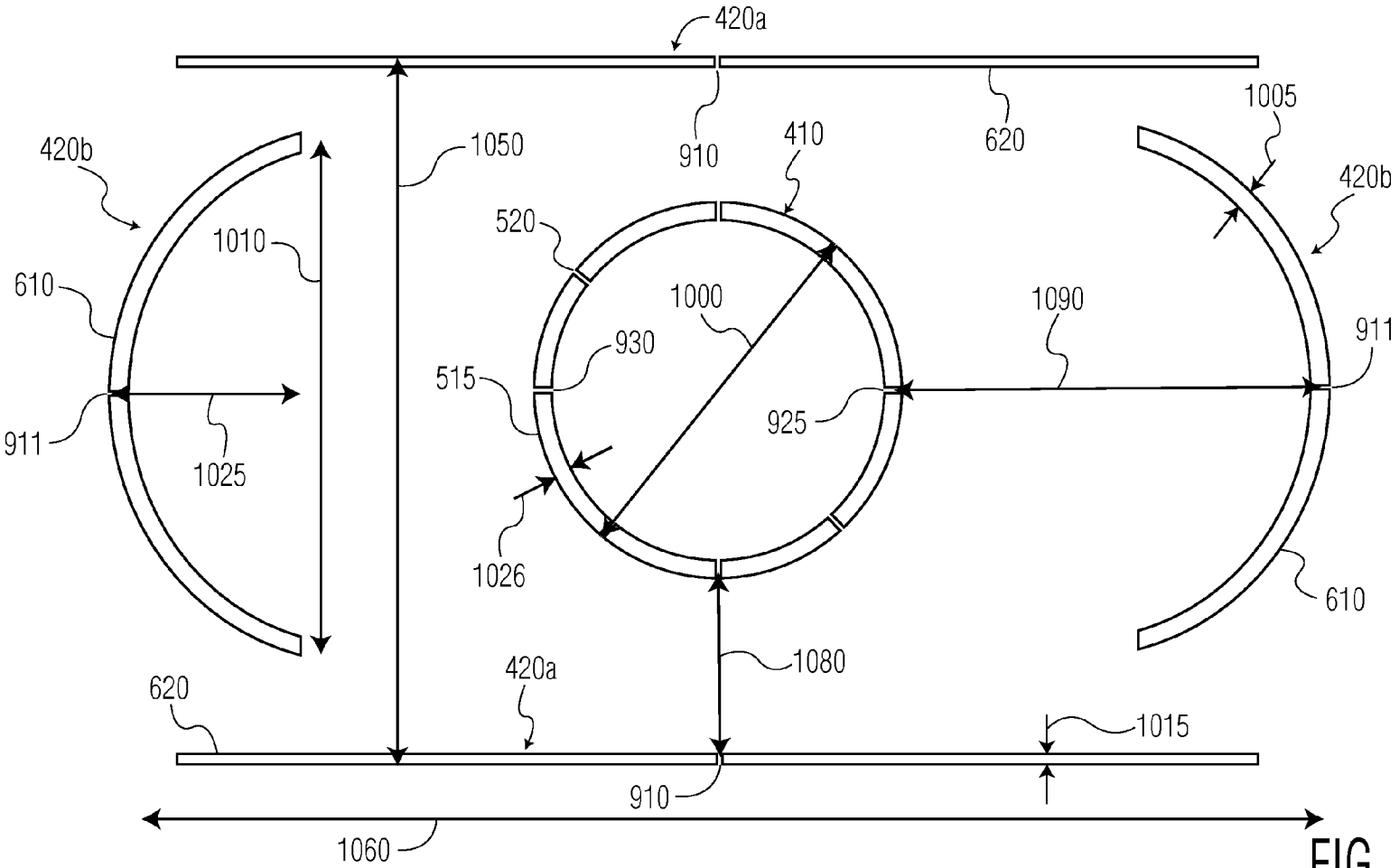
FIG. 10 shows an embodiment in accordance with the invention.

FIG. 10 shows the dimensions for an embodiment in accordance of the invention. The dimensions are determined for the appropriate resonance frequency using computer simulations of the electromagnetic field. Typical computer simulation packages that are used are HFSS (commercial finite element method solver) and CST (Computer Simulation Technology; time domain solver was used). Diameter 1000 of segmented loop 410 is about 5.0 cm. Separation 1090 between curved segment 610 and segmented loop 410 is about 5.6 cm. Separation 1050 between linear segments 620 is about 9.0 cm. Distance 1060 is the length of dielectric substrate 440 which is about 16.5 cm. Separation 1080 between segmented loop 410 and linear segment 620 is about 2.0 cm. Dimension 1010 of curved segments 610 is about 8.0 cm and dimension 1025 of curved segments is about 3.0 cm. Width 1026 of curved segments 515 is about 0.2 cm, width 1005 of curved segments 610 is about 0.2 cm and width 1015 of linear segments 620 is about 0.1 cm. Each linear segment 620 is about 6.6 cm in length and each curved segment 515 is about 1.9 cm in length. All gaps 520, 925, 930, 910, 911 are about 0.05 cm across. The size of the gaps 520, 925, 930, 910, 911 can be modified depending on the package and footprint of capacitors 525 and resistors 950 that are used.

More generally, separations 1080 and 1090 are the distances from segmented loop 410 to dipole structures 420*a* and 420*b*, respectively. Separations 1080 and 1090 together with the resonance length of dipole structures 420*a* and 420*b* determine distances 675 and 680 (see FIG. 6*b*). Hence, distances 675 and 680 are determined by diameter 1000 of segmented loop 410, the resonance length of dipole structures 420*a* and 420*b* and separations 1080 and 1090, respectively. It is important that curved segment 610 overlaps with straight segment 620; the amount of overlap is determined by diameter 1000 of segmented loop 410, the resonance length of dipole structures 420*a* and 420*b* and separations 1080 and 1090, respectively. When the geometries of segmented loop 410 and dipole structures 420*a* and 420*b* do not allow for an overlap due to, for example, scaling, the limits of a functioning antenna 400 in accordance with the invention are reached and actions are required to ensure there is an overlap. For example, dielectric substrate 440 may be replaced with a dielectric substrate having a lower dielectric constant to allow for an increase in the length of dipole structures 420*a* and 420*b* to create an overlap.

Curved dipole segments 610 are curved at a specific angle and comprise arc segments of a circle whose diameter typically needs to be about 60 percent to 70 percent larger than diameter 1000 of segmented loop 410. This requirement together with separations 1080 and 1090, diameter 1000 of segmented loop 410 and the length of dipole structures 420*a* and 420*b* ensures that separation 675 is within the proper range.

FIGS. 11*a-d* show the electric field 1120 along the direction of passive dipole structures 420 and the electric field 1130 at for the same locations with passive dipole structures 420 removed for an embodiment in accordance with the invention.

Figure 11A:
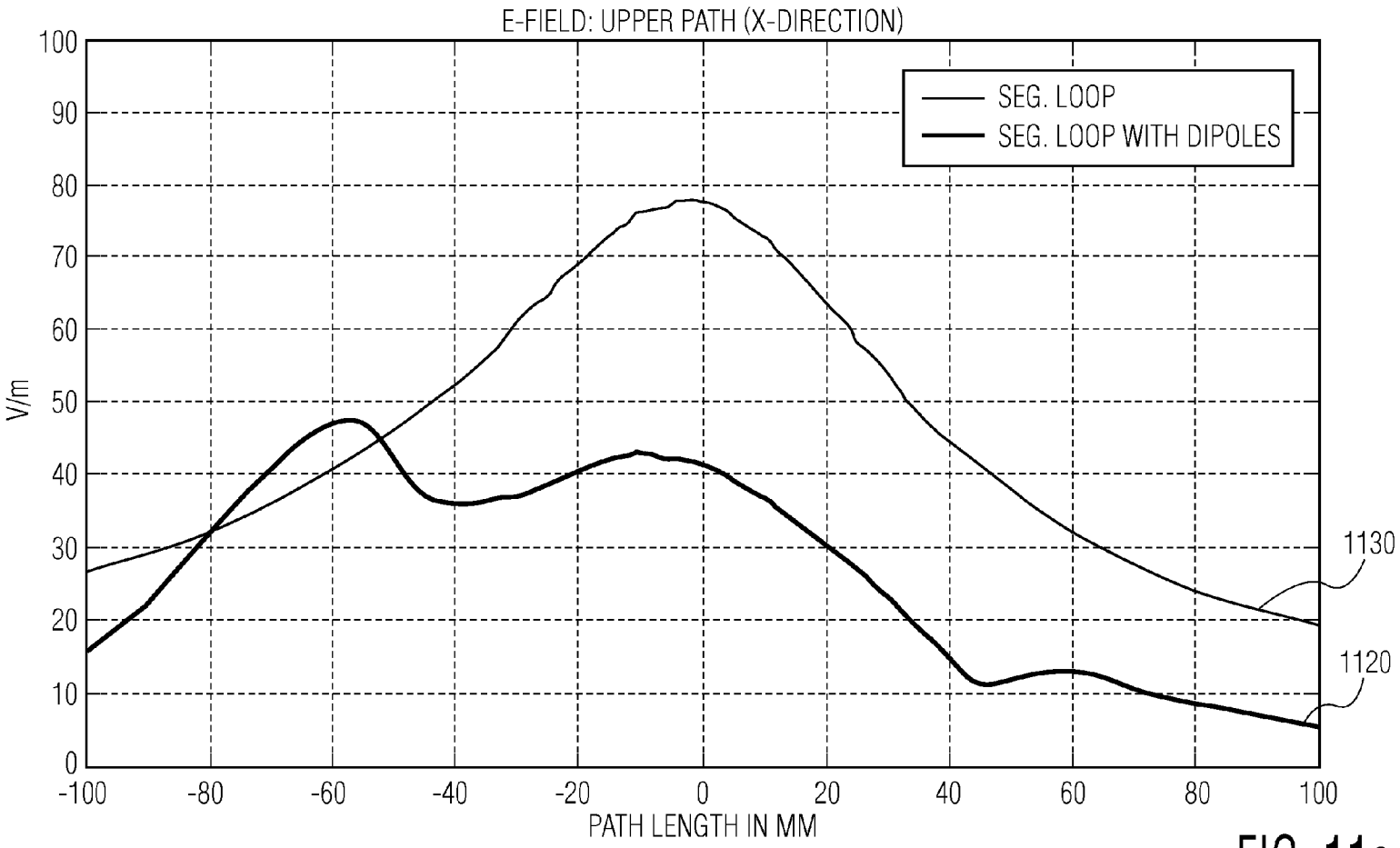
FIG. 11*a* compares the electric field of an embodiment in accordance with the invention with an embodiment not in accordance with the invention.
Figure 11B:
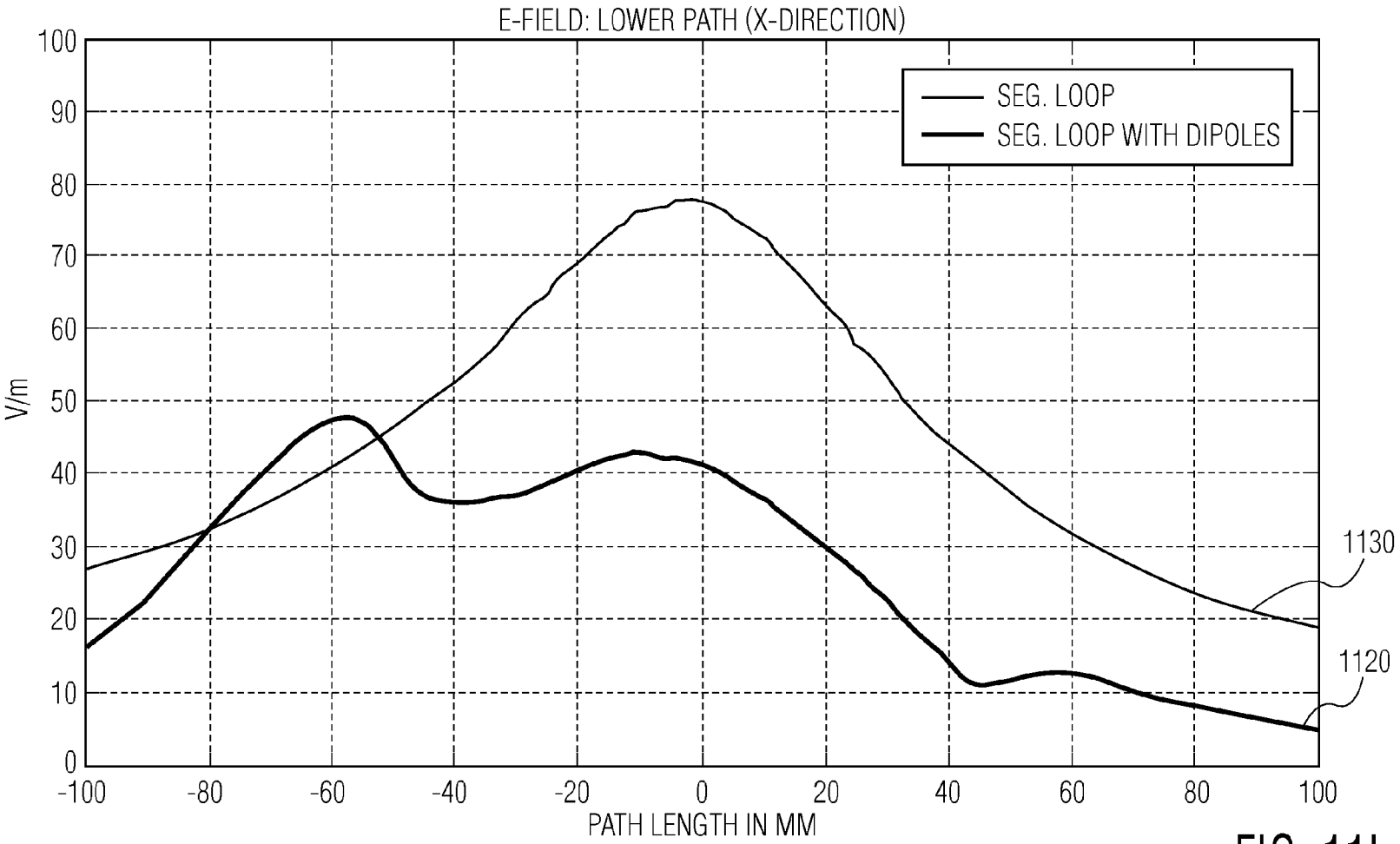
FIG. 11*b* compares the electric field of an embodiment in accordance with the invention with an embodiment not in accordance with the invention.

FIGS. 11*a* and 11*b* show electric field 1120 along the direction of top passive dipole structures 620 (x=−100 mm, y=50 mm, z=10 mm to x=100 mm, y=50 mm, z=10 mm where x=0, y=0 and z=0 is the center of segmented loop 410) and bottom passive dipole structures 620 (x=−100 mm, y=−50 mm, z=10 mm to x=100 mm, y=−50 mm, z=10 mm where x=0, y=0 and z=0 is the center of segmented loop 410), respectively. For comparison, electric field 1130 with all passive dipole structures 620 and 610 removed is shown.

Figure 11C:
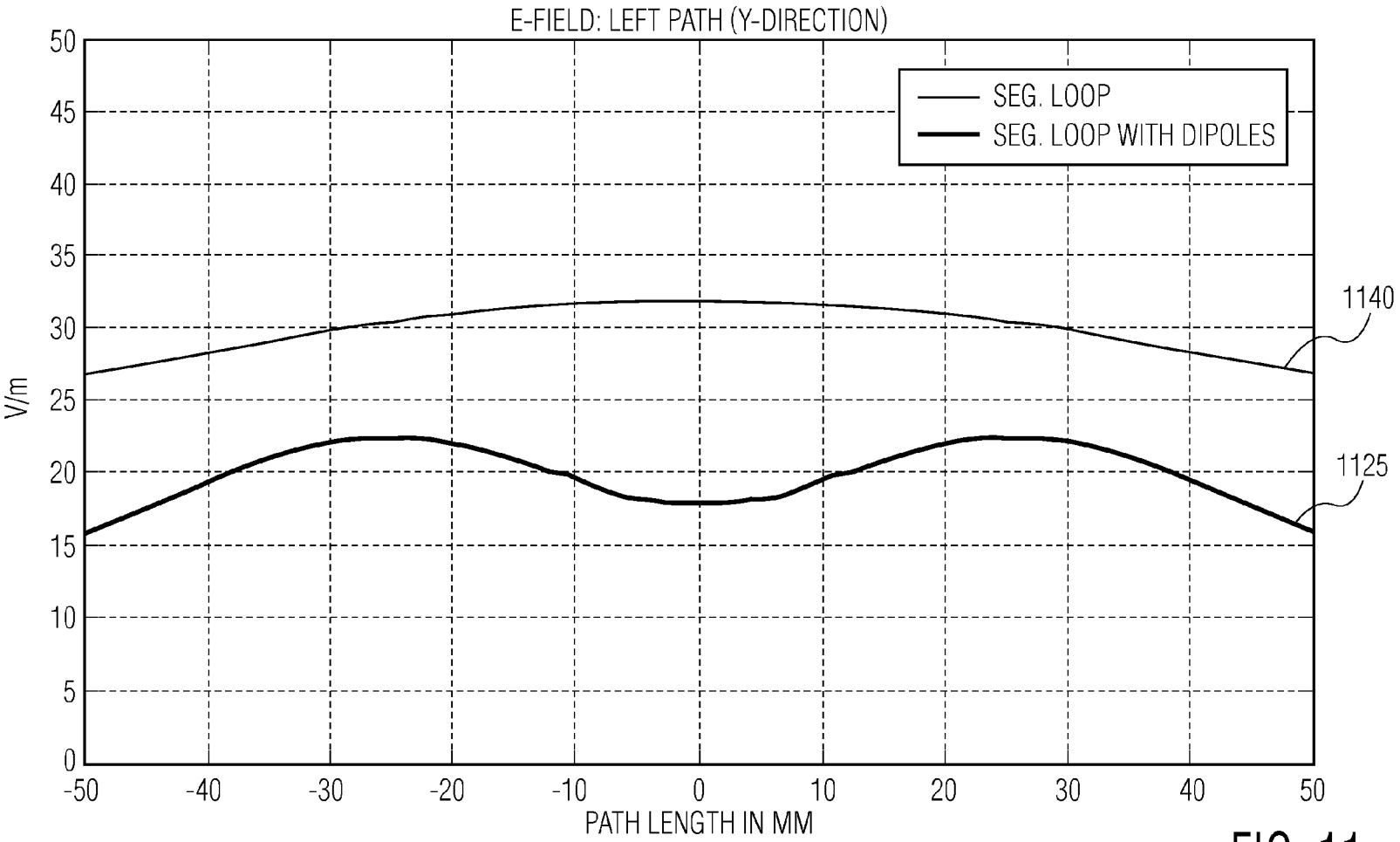
FIG. 11*c* compares the electric field of an embodiment in accordance with the invention with an embodiment not in accordance with the invention.

FIG. 11*c* shows electric field 1125 along the direction of passive dipole structure 610 on the left side of FIG. 9 (x=−100 mm, y=−50 mm, z=10 mm to x=−100 mm, y=50 mm, z=10 mm where x=0, y=0 and z=0 is the center of segmented loop 410) which has matching circuit 931 including a balun. For comparison, electric field 1140 with all passive dipole structures 610 and 620 removed is shown.

Figure 11D:
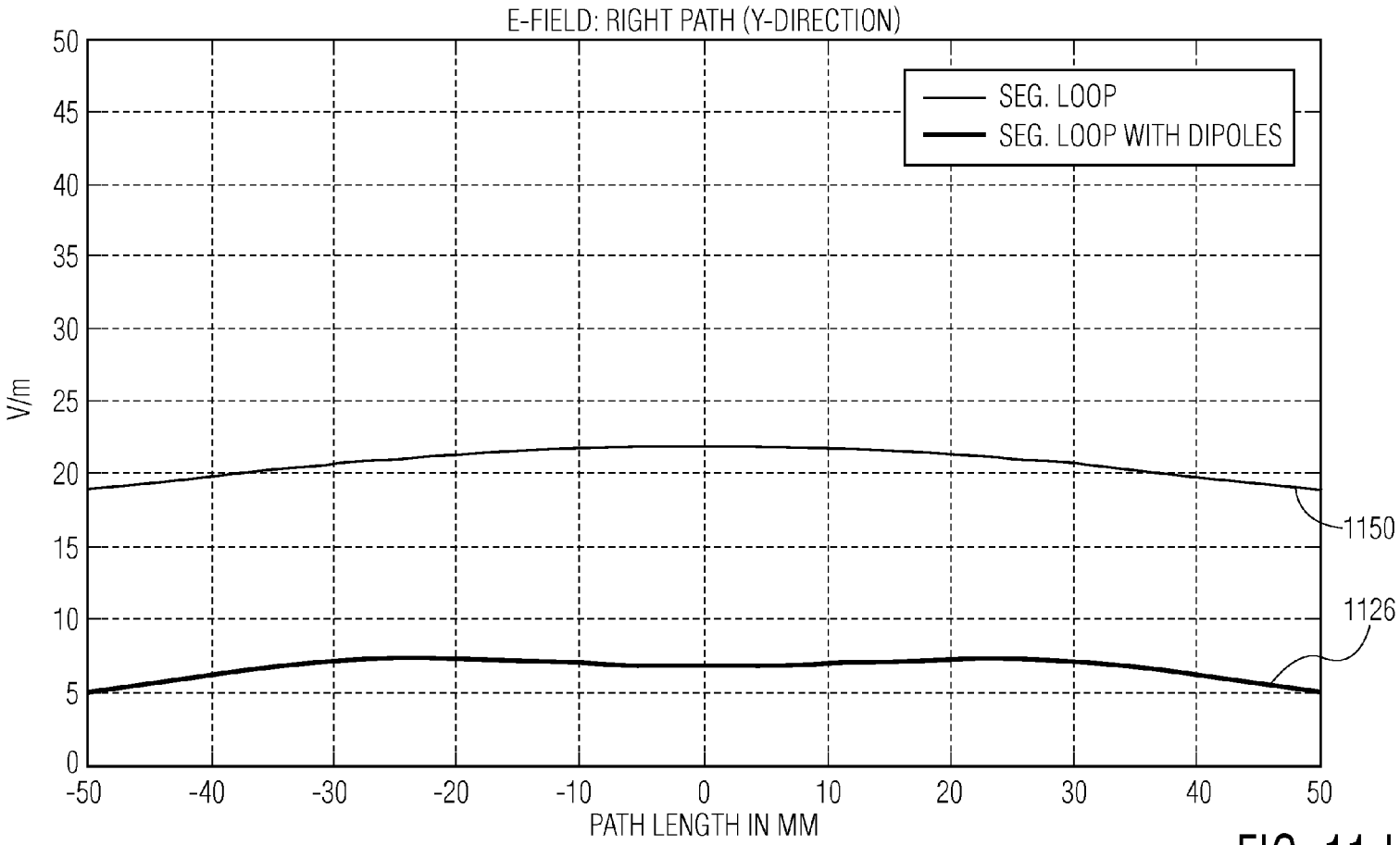
FIG. 11*d* compares the electric field of an embodiment in accordance with the invention with an embodiment not in accordance with the invention.

FIG. 11*d* shows electric field 1126 along the direction of passive dipole structure 610 on the right side of FIG. 9 (x=100 mm, y=−50 mm, z=10 mm to x=100 mm, y=50 mm, z=10 mm where x=0, y=0 and z=0 is the center of segmented loop 410. For comparison, electric field 1140 with all passive dipole structures 610 and 620 removed is shown. Note the difference in the electric fields 1125 and 1126 as well as electric fields 1140 and 1150 due to the location of the feed-in point (part of matching circuit 931) on the left side of segmented loop 410 and 91Ω resistor 951 in FIG. 9.

Figure 12:
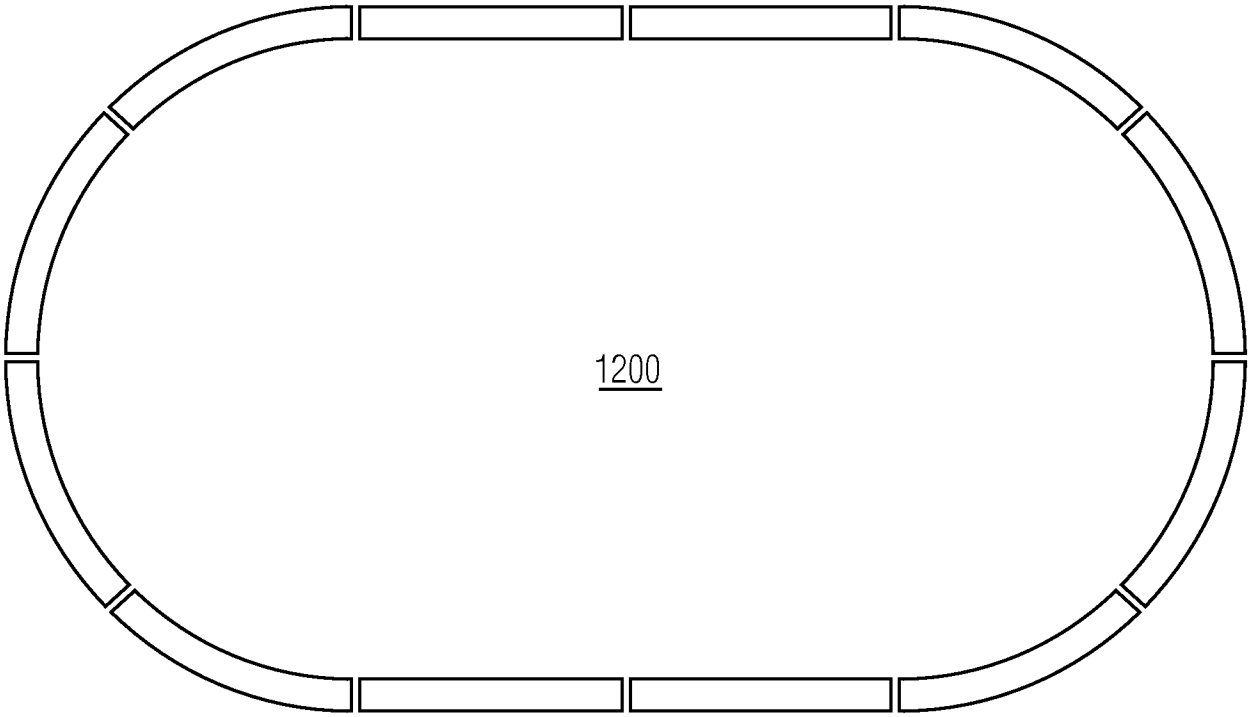
FIG. 12 shows an alternative embodiment for the segmented loop in accordance with the invention.

FIG. 12 shows segmented loop 1200 as an alternative to segmented loop 410 in accordance with the invention. Segmented loop is ellipsoidal in shape and generates a field that extends further to the left and right than the field for segmented loop 410 assuming the minor elliptical axis of segmented loop 1200 is about the radius of segmented loop 410. Note that low order polygonal segmented loops such as rectangular or square segmented loops are typically to be avoided as sharp corners disrupt an in-phase and constant in magnitude current. Because a current flux occurs at the edges of a conductive path, there is typically a higher current density at the inner angle of a sharp corner compared to the outer angle of the sharp corner as the current chooses the shortest possible path. This typically leads to unwanted radiation.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

The invention claimed is:

1. An RFID reader antenna comprising:

a loop comprised of a plurality of segments disposed on a dielectric substrate; and a plurality of passive dipole segments disposed on the dielectric substrate, the plurality of passive dipole segments disposed about the loop such that the plurality of passive dipole segments are in resonance with the loop and function to reflect and partially absorb energy from a radiative field emitted by the loop, wherein the plurality of passive dipole segments includes first and second passive dipole segments that are linear in shape and third and fourth passive dipole segments that are curved in shape, each of the first, second, third and fourth passive dipole segments being positioned on a different side of the loop, wherein the first and second passive dipole segments are positioned on opposites sides of the loop and the third and fourth passive dipole segments are positioned on another opposite sides of the loop.

2. The RFID reader antenna of claim 1 wherein the plurality of segments of the loop are electrically coupled to one another by capacitors.

3. The RFID reader antenna of claim 1 wherein the loop is circular in shape.

4. The RFID reader antenna of claim 1 wherein the loop is elliptical in shape.

5. The RFID reader antenna of claim 1 wherein some of the first portion of the plurality of passive dipole segments are electrically coupled to one another by resistors.

6. The RFID reader antenna of claim 1 wherein the dielectric substrate is fiberglass reinforced epoxy laminate.

7. The RFID reader antenna of claim 1 wherein the plurality of segments is comprised of copper.

8. The RFID reader antenna of claim 1 further comprising a matching circuit electrically coupled to the loop.

9. The RFID reader antenna of claim 8 wherein the matching circuit comprises a balun.

10. The RFID reader antenna of claim 1 wherein each of the plurality of segments has a length of about one eighth of the resonant wavelength.

11. The RFID reader antenna of claim 2 wherein at least two of the plurality of segments are coupled to one another using a resistor.

12. The RFID reader antenna of claim 1 wherein the loop and plurality of passive dipole segments on the dielectric substrate are adapted to define a read zone.

13. The RFID reader antenna of claim 1 wherein the first passive dipole segment overlaps with the third passive dipole segment.

14. A method for making an RFID reader antenna comprising:

providing a loop comprised of a plurality of segments disposed on a dielectric substrate; and providing a plurality of passive dipole segments disposed on the dielectric substrate, the plurality of passive dipole segments disposed about the loop such that the plurality of passive dipole segments are in resonance with the loop and function to reflect and partially absorb energy from a radiative field emitted by the loop, wherein the plurality of passive dipole segments includes first and second passive dipole segments that are linear in shape and third and fourth passive dipole segments that are curved in shape, each of the first, second, third and fourth passive dipole segments being positioned on a different side of the loop, wherein the first and second passive dipole segments are positioned on opposites sides of the loop and the third and fourth passive dipole segments are positioned on another opposite sides of the loop.

15. The method of claim 14 wherein the first passive dipole segment overlaps with the third passive dipole segment.

16. An RFID reader antenna comprising:

a loop comprised of a plurality of segments disposed on a dielectric substrate; and a plurality of passive dipole segments disposed on the dielectric substrate, the plurality of passive dipole segments disposed about the loop such that the plurality of passive dipole segments are in resonance with the loop and function to reflect and partially absorb energy from a radiative field emitted by the loop, wherein the plurality of passive dipole segments comprise a first passive dipole segment that is curved in shape and a second passive dipole segment that is linear in shape, and wherein the first passive dipole segment overlaps with the second passive dipole segment.

* * * * *